US011774071B1

(12) United States Patent
Hsu et al.

(10) Patent No.: US 11,774,071 B1
(45) Date of Patent: Oct. 3, 2023

(54) LIGHT-EMITTING MODULE AND BUTTON STRUCTURE AND ELECTRONIC DEVICE INCLUDING THE SAME

(71) Applicant: WiBASE Industrial Solutions Inc., Taipei (TW)

(72) Inventors: Che Chuan Hsu, Taipei (TW); Guan Shin Luo, Taipei (TW)

(73) Assignee: WIBASE INDUSTRIAL SOLUTIONS INC., Taipei (TW)

( * ) Notice: Subject to any disclaimer, the term of this patent is extended or adjusted under 35 U.S.C. 154(b) by 0 days.

(21) Appl. No.: 18/052,593

(22) Filed: Nov. 4, 2022

(30) Foreign Application Priority Data

Jul. 27, 2022 (TW) ..... 111128117

(51) Int. Cl.

| | |
|---|---|
| ***F21V 19/00*** | (2006.01) |
| ***F21V 11/00*** | (2015.01) |
| ***F21Y 115/10*** | (2016.01) |
| ***F21Y 105/18*** | (2016.01) |

(52) U.S. Cl.
CPC ..... *F21V 19/001* (2013.01); *F21V 11/00* (2013.01); *F21Y 2105/18* (2016.08); *F21Y 2115/10* (2016.08)

(58) Field of Classification Search
CPC ..... H01H 2009/189; G08B 25/016; G02B 27/00; F21V 19/001; F21V 11/00
See application file for complete search history.

(56) References Cited

U.S. PATENT DOCUMENTS

| | | | | |
|---|---|---|---|---|
| 8,324,518 | B2 * | 12/2012 | Furrer | H01H 3/122 200/341 |
| 9,443,676 | B2 * | 9/2016 | Na | H01H 13/14 |
| 9,728,349 | B2 | 8/2017 | Huang et al. | |
| 9,728,355 | B2 | 8/2017 | Chu | |
| 10,068,722 | B2 * | 9/2018 | Luo | H01H 13/023 |
| 10,317,845 | B2 * | 6/2019 | Zhang | A44C 5/00 |
| 10,542,603 | B2 * | 1/2020 | Pham | H05B 45/00 |
| 11,107,648 | B2 * | 8/2021 | Duncan | F21V 19/001 |
| 11,512,840 | B2 * | 11/2022 | Jackson | F21V 21/0965 |
| 2002/0079208 | A1 * | 6/2002 | Campana | H01H 13/023 200/310 |
| 2008/0000763 | A1 * | 1/2008 | Cove | H01H 13/023 200/317 |

(Continued)

FOREIGN PATENT DOCUMENTS

| | | |
|---|---|---|
| CN | 106373812 A | 2/2017 |
| TW | I540606 B | 7/2016 |

OTHER PUBLICATIONS

TW Office Action dated Mar. 24, 2023 in Taiwan application No. 111128117.

*Primary Examiner* — Arman B Fallahkhair
(74) *Attorney, Agent, or Firm* — McClure, Qualey & Rodack, LLP

(57) ABSTRACT

A light-emitting module is adapted for a light-permeable button and includes a substrate, a switch, and a plurality of light-emitting units, the switch is disposed on the substrate and configured to contact the light-permeable button, the light-emitting units are disposed on the substrate and surround the switch, and the light-emitting units are disposed on the substrate, spaced apart by each other, and arranged to correspond to a light-receiving surface of the light-permeable button.

5 Claims, 7 Drawing Sheets

(56) References Cited

U.S. PATENT DOCUMENTS

| | | | | |
|---|---|---|---|---|
| 2010/0220495 | A1* | 9/2010 | Truesdale | H01H 13/023<br>362/253 |
| 2012/0075872 | A1* | 3/2012 | Byrne | G08B 25/016<br>362/362 |

* cited by examiner

LIGHT-EMITTING MODULE AND BUTTON STRUCTURE AND ELECTRONIC DEVICE INCLUDING THE SAME

CROSS-REFERENCE TO RELATED APPLICATIONS

This non-provisional application claims priority under 35 U.S.C. § 119(a) on Patent Application No(s). 111128117 filed in Taiwan (R.O.C.) on Jul. 27, 2022, the entire contents of which are hereby incorporated by reference.

TECHNICAL FIELD

The disclosure relates to a light-emitting module and a button structure and an electronic device including the same.

BACKGROUND

As the demand for long term care increases, various wearable devices for medical care are shown on the market, which can add functions such as physiological information sensing, monitoring and/or communication as required, so as to continuously record or track the user's blood pressure, heartbeat, body temperature, and other physiological information, and such devices are able to immediately alert the wearer and associated staffs or agencies when an abnormal events happens. In order to timely react to that, such devices have an emergency button thereon for the wearer to directly call for help. The emergency button on the existing wearable devices is large in size and easy to press, but is not legible enough to be read by someone under some urgent situations.

SUMMARY

Accordingly, one aspect of the disclosure is to provide a light-emitting module and a button structure and an electronic device including the same which are capable of improving the legibility of button.

One embodiment of the disclosure provides a button structure including a light-emitting module and a button, the light-emitting module includes a substrate, a switch disposed on the substrate, and a plurality of light-emitting units disposed on the substrate and surrounding the switch, the button includes a pressing structure and a covering portion, the pressing structure and the covering portion are light-permeable, the pressing structure is located between the covering portion and the switch, and the plurality of light-emitting units correspond to a light-receiving surface of the pressing structure.

Another embodiment of the disclosure provides an electronic device including a casing, a light-emitting module, and a button, the light-emitting module includes a substrate disposed on the casing, a switch disposed on the substrate, and a plurality of light-emitting units disposed on the substrate and surrounding the switch, the button includes a pressing structure and a covering portion, the pressing structure and the covering portion are light-permeable, the pressing structure is located between the covering portion and the switch, and the plurality of light-emitting units correspond to a light-receiving surface of the pressing structure.

Another embodiment of the disclosure provides a light-emitting module, adapted for a light-permeable button, including a substrate, a switch, and a plurality of light-emitting units, the switch is disposed on the substrate and configured for contacting the light-permeable button, the light-emitting units are spaced apart from each other, disposed on the substrate, surrounding the switch, and configured for corresponding to a light-receiving surface of the light-permeable button.

According to the light-emitting module and the button structure and the electronic device as discussed in the above embodiments of the disclosure, the light-emitting unit of the light-emitting module is arranged to correspond to the light-receiving surface of the light-permeable button, thus the light-emitting module is allowed to directly project light to the button, which helps improve both the legibility and aesthetics of the button and also helps achieve light effect in response to the interaction between the user and the button structure.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

Aspects and advantages of the disclosure will become apparent from the following detailed descriptions with the accompanying drawings. The inclusion of such details provides a thorough understanding of the disclosure sufficient to enable one skilled in the art to practice the described embodiments but it is for the purpose of illustration only and should not be understood to limit the disclosure. On the contrary, it is intended to cover alternatives, modifications, and equivalents as can be included within the spirit and scope of the described embodiments as defined by the appended claims. To this end, those skilled in the relevant art will recognize and appreciate that many changes can be made to the various aspects of the disclosure described herein, while still obtaining the beneficial results of the present disclosure. It will also be apparent that some of the desired benefits of the present disclosure can be obtained by selecting some of the features of the present disclosure without utilizing other features.

It is to be understood that the phraseology and terminology used herein are for the purpose of better understanding the descriptions and should not be regarded as limiting. As used herein, the terms "substantially" or "approximately" may describe a slight deviation from a target value, in particular a deviation within the production accuracy and/or within the necessary accuracy, so that an effect as present with the target value is maintained. Unless specified or limited otherwise, the phrase "at least one" as used herein may mean that the quantity of the described element or component is one or more than one but does not necessarily mean that the quantity is only one. The term "and/or" may be used herein to indicate that either or both of two stated possibilities. Unless specified or limited otherwise, the terms "mounted", "connected", "disposed", "fixed", and variations thereof are used broadly and encompass both direct and indirect mounting, connection, disposing, and fixing.

Figure 1:
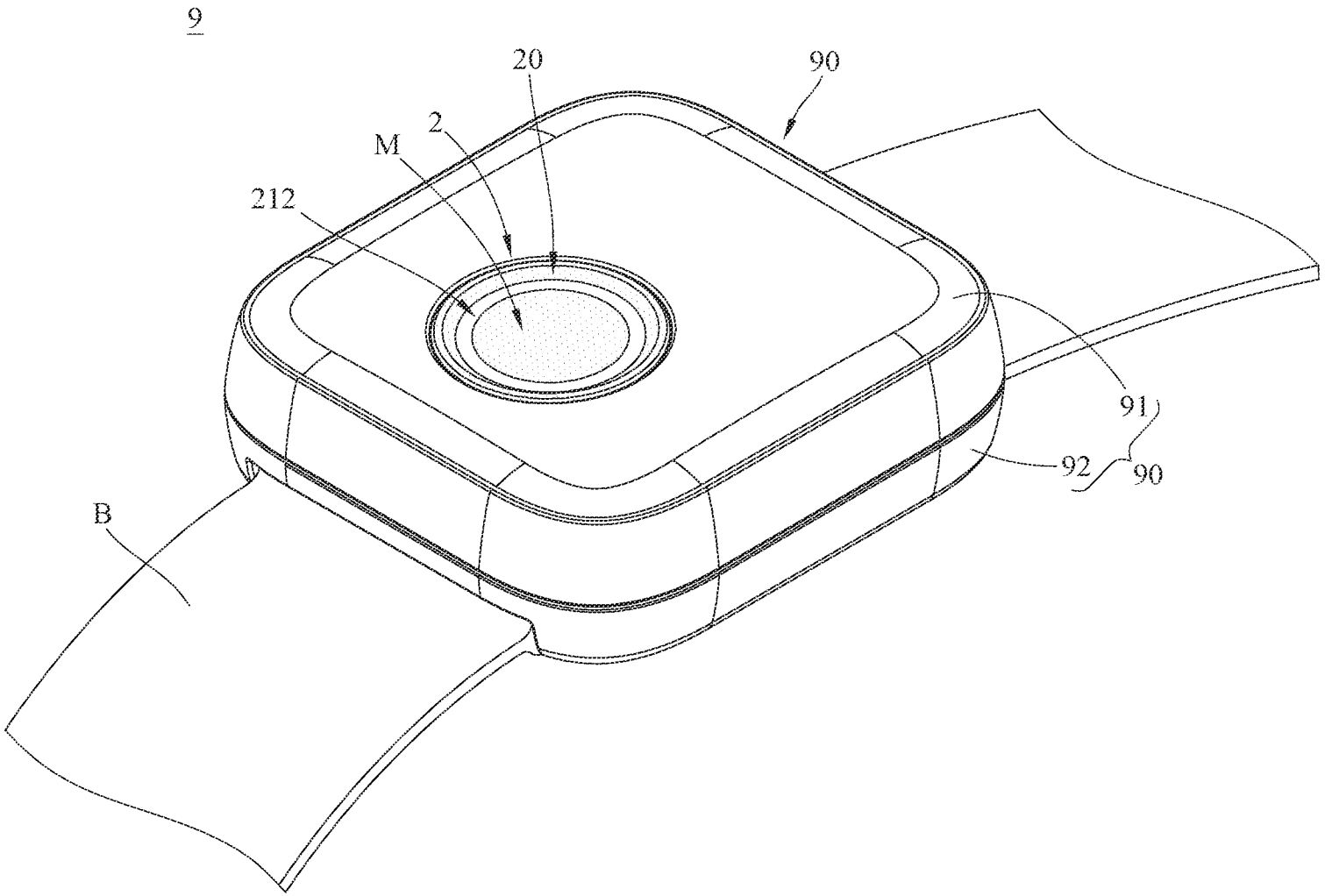
FIG. 1 is a perspective view of an electronic device according to one embodiment of the disclosure.

Referring to FIG. 1, one embodiment of the disclosure provides an electronic device 9, the electronic device 9 may include a button structure 2, as shown, the button structure 2 may include a light-permeable button 20 (may be simply called "button 20" hereinafter), at least part of the button 20 is exposed to outside from the electronic device 9 for user to activate predetermined function. In some applications, an electronic device which has the button structure therein may be employed as an independent button device. For example, in this embodiment, the button structure 2 may be connected to a watch strap B so that user can wear the button structure 2 on wrist; in other words, the electronic device 9 may be, but is not limited to be, a wearable button device.

It is noted that the applications and usage of the electronic device are not limiting. In other embodiments, the electronic device may omit the watch strap and may be directly attached on wall; alternatively, in another embodiment, the electronic device may be integrated into other devices, such as Television, refrigerator, dehumidifier, air conditioner, laptop computer, or server. In any one of the aforementioned applications, the button of the button structure may be served as a power button. For the convenience of description, the followings take the electronic device of an exemplary embodiment of the disclosure as a wearable device.

Figure 2:
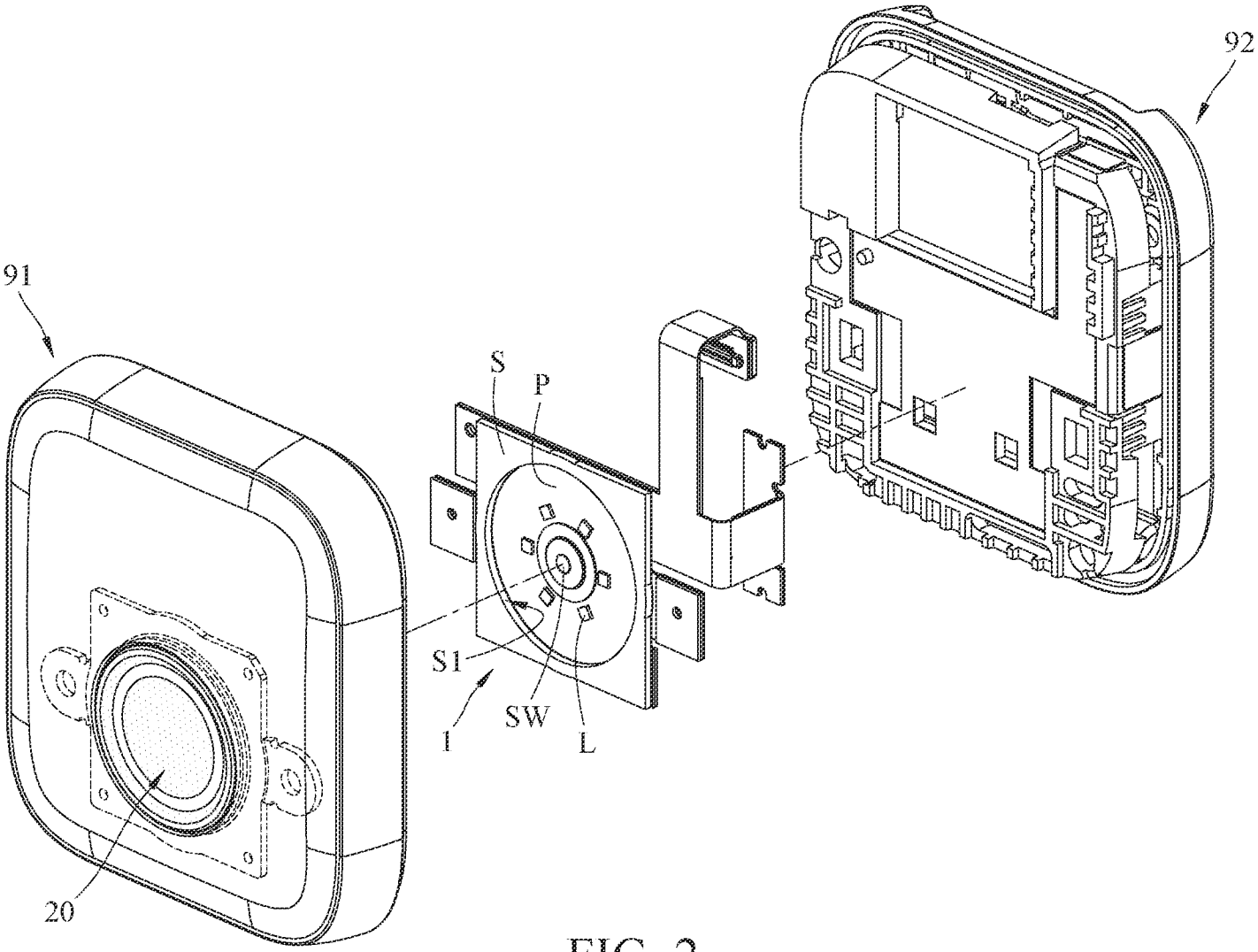
FIG. 2 is an exploded view of a casing and a light-emitting module of the electronic device according to one embodiment of the disclosure.

Please refer to FIG. 1 and further refer to FIG. 2, the electronic device 9 may include a casing 90, the casing 90 may be employed as the appearance of the electronic device 9. The casing 90 is able to accommodate the button structure 2. The casing 90 may include a plurality of smaller pieces assembled together. For example, in this embodiment, the casing 90 may include a first casing part 91 and a second casing part 92. The first casing part 91 may be assembled to the second casing part 92 using any suitable means. The first casing part 91 and the second casing part 92 are able to support and accommodate the button structure 2 therein. The button 20 may partially exposed to the outside from the first casing part 91 for user to operate the electronic device 9. It is noted that the casing 90 and its configuration are exemplary and are not intended to limit the disclosure. In another embodiment, the casing may be an integrally formed single piece made of any suitable material. In another embodiment, the casing may be an assembly of more than three smaller pieces.

In this embodiment, there is a light-emitting module 1 accommodated within the casing 90 of the electronic device 9. The light-emitting module 1 corresponds to the button 20. The light-emitting module 1 is able to emit light continuously or when being pressed by the button 20. The button 20 is able to guide the light emitted by the light-emitting module 1 to the outside. Note that the casing 90 may accommodate other electronic components as required, such as circuit board, processing unit, memory, microphone, speaker, antenna, battery (not shown) which can achieve functions, such as physiological monitoring sensor and/or information communication.

Figure 3:
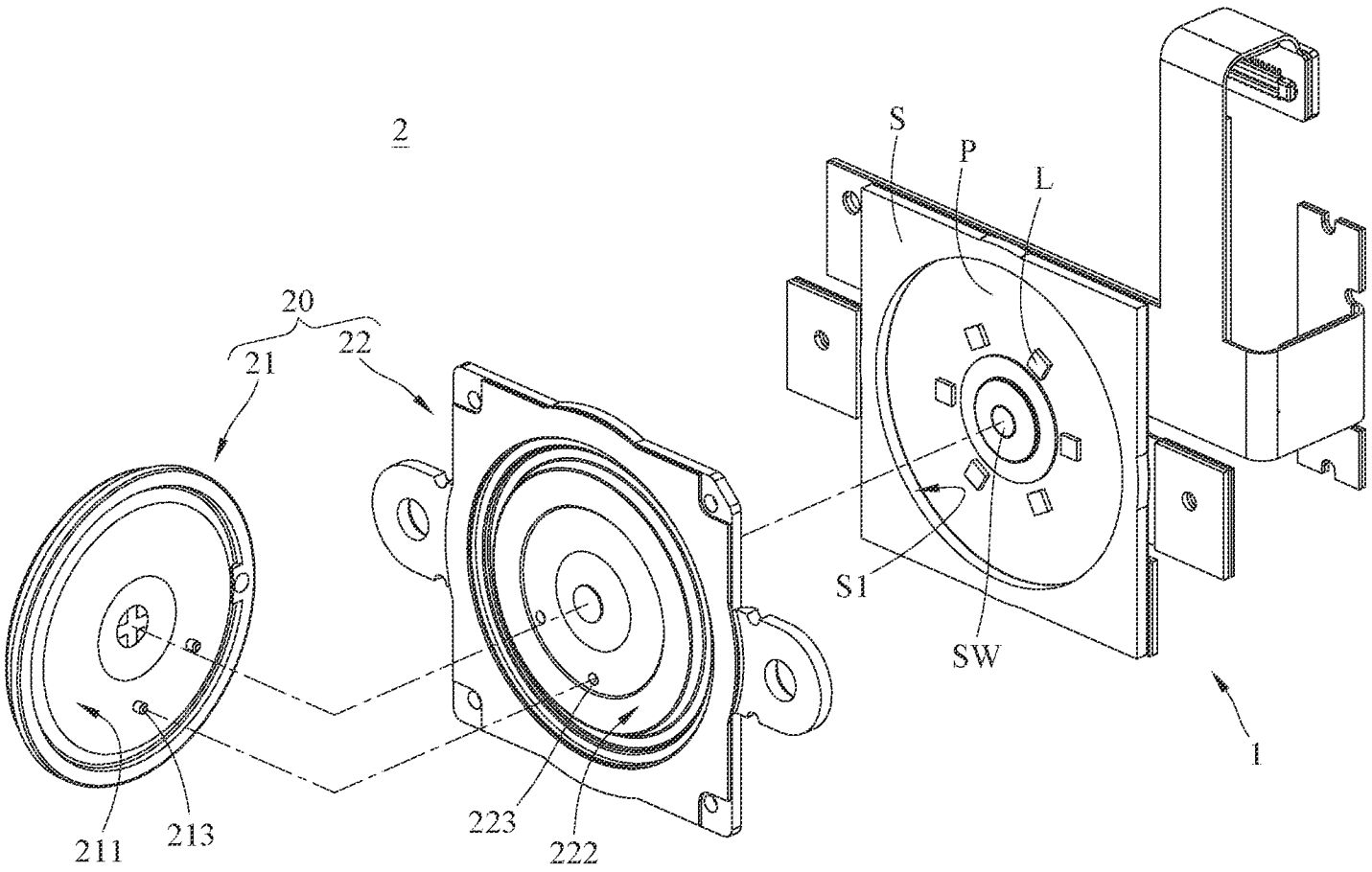
FIG. 3 is an exploded view of a button structure according to one embodiment of the disclosure.
Figure 4:
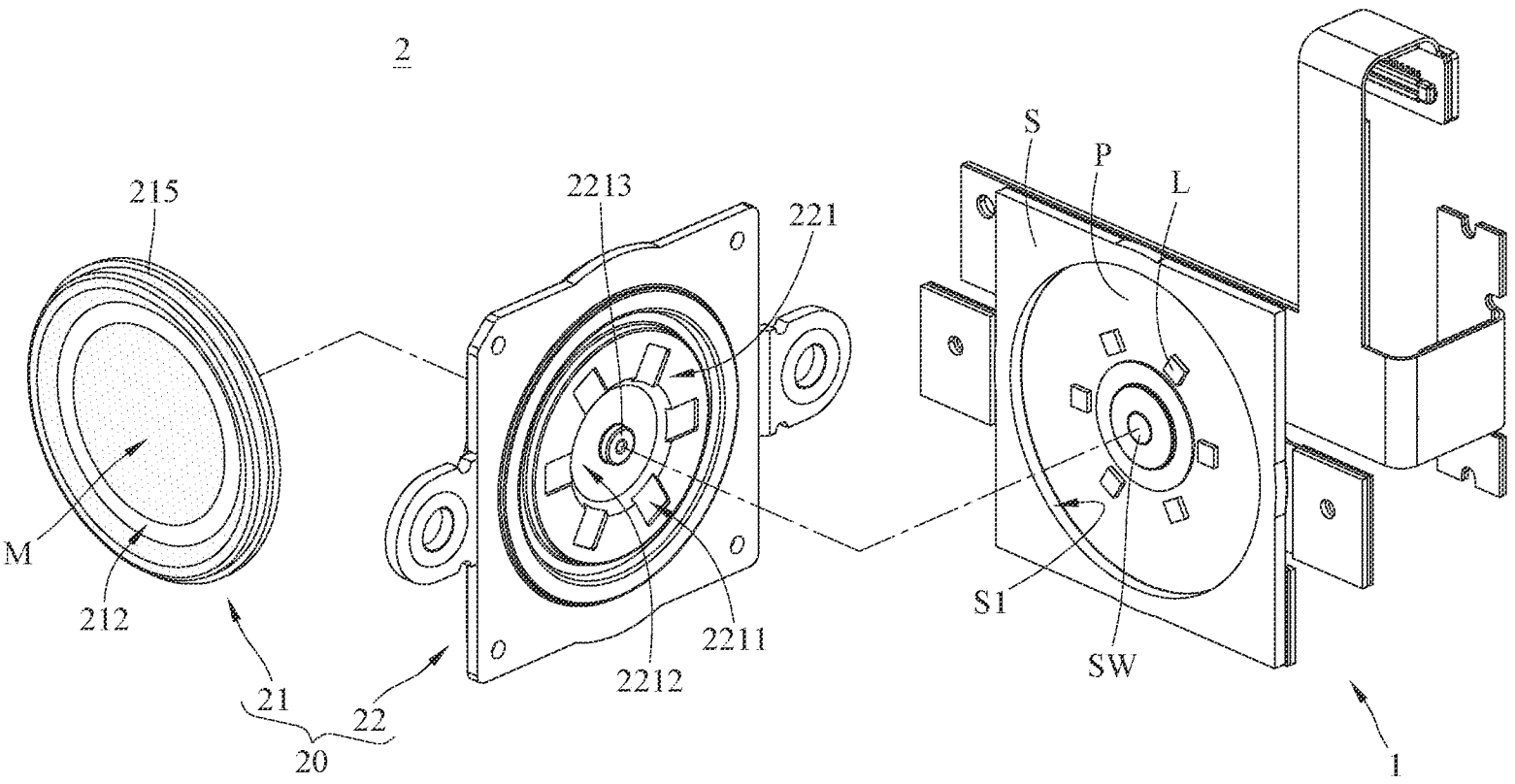
FIG. 4 is an exploded view of the button structure according to one embodiment of the disclosure taken from another angle.

The details of the button structure 2 and the light-emitting module 1 are given below with further reference to FIGS. 3-4. In this embodiment, the light-emitting module 1 may include a substrate P, a switch SW, and a plurality of light-emitting units L, the button 20 may include a covering portion 21 and a pressing structure 22.

The substrate P may be any suitable circuit board and may be fixed to the first casing part 91 and/or the second casing part 92 of the casing 90 using any suitable means. The substrate P is overlapping with the button 20 in a specific direction. The associated electronic components accommodated in the casing 90 may be electrically connected to the substrate P via any suitable cable or connector.

Any suitable switch can be employed as the switch SW of the disclosure. The switch SW may be disposed on the substrate P and may be overlapping with the button 20 and the substrate P in a specific direction. For example, in a direction which the switch SW can be activated, the switch SW, the button 20, and the substrate P are overlapping with one another. The switch SW is configured for receiving the press or contact of the button and is able to trigger predetermined functions when being activated by the button 20.

The light-emitting units L may be, but is not limited to be, any suitable LED (light-emitting diode). The light-emitting units L may be disposed on the substrate P. As shown, the switch SW and the light-emitting units L may be disposed on the same surface of the substrate P. The light-emitting units L are also overlapping with the button 20. The light-emitting unit L may be spaced apart from one another and arranged to surround the switch SW. For example, as shown, the light-emitting units L may be arranged with the same interval in a circumferential direction so as to surround the switch SW. Optionally, each of the light-emitting units L may be spaced apart from the switch SW by the same distance.

Optionally, the light-emitting module 1 may further include a spacer S, the spacer S may be made of any suitable compressible material. The spacer S can be served as a gasket arranged between the button 20 and the substrate P. In specific, the spacer S and the light-emitting units L may be disposed on the same surface of the substrate P. In one embodiment, the spacer S and the light-emitting units L may be coplanar with one another and the spacer S may surround the light-emitting units L; in other words, in the direction which the switch SW can be activated, the spacer S does not overlap with the light-emitting units L. As shown, the spacer S may have a surrounding sidewall 51 surrounding the light-emitting units L, thus the spacer S is able to prevent the light emitted by the light-emitting units L from reaching the holes (e.g., sound receiving hole) in the lateral direction, such that light is prevented from leaking out from the holes not supposed to be light-permeable.

The covering portion 21 and the pressing structure 22 are stacked on each other. In this embodiment, the covering portion 21 may be served as the part of the button 20 exposed from the casing 90 and used for receiving contact of user's finger. The covering portion 21 is movably disposed on the first casing part 91 of the casing 90. The covering portion 21 may be made of any suitable light-permeable material. For example, the covering portion 21 may be made of light-permeable plastic. The covering portion 21 has a light-receiving surface 211 and a light-emitting surface 212 located opposite to each other. The light-receiving surface 211 means the surface or area of the covering portion 21 facing the light-emitting units L. The light-receiving surface 211 is configured to receive light emitted from the light-emitting units L. The light-emitting surface 212 means the surface or area of the covering portion 21 exposed to the outside from the casing 90. The light-emitting surface 212 is configured to emit light to the outside. In the direction which the switch SW can be activated, the light-emitting units L overlap with the light-receiving surface 211 and the light-emitting surface 212.

Optionally, the covering portion 21 may have a radially protruding portion 215 protruding radially from the edge of the covering portion 21. More specifically, the radially protruding portion 215 may radially protrude from the edge of the covering portion 21 located close to the light-receiving surface 211. Correspondingly, the first casing part 91 has an annular stopping portion 911 at an opening 910 thereof. In detail, the opening O is configured for partially exposing the covering portion 21. For example, the opening O at least exposes the light-emitting surface 212 of the covering portion 21. The annular stopping portion 911 extends radially inward from edge which forms the opening 910. When the covering portion 21 is disposed on the first casing part 91, the annular stopping portion 911 corresponds to the radially protruding portion 215 so as to prevent the covering portion 21 from falling off from the opening 910 of the first casing part 91.

Optionally, there may be a recessed portion 2221 formed on the light-emitting surface 222 of the pressing structure 22, the recessed portion 2221 may correspond to the radially protruding portion 215 of the covering portion 21. Thus, when the covering portion 21 is pressed to deform the radially protruding portion 215, the recessed portion 2221 prevents from interfering with the covering portion 21 and thus preventing from affecting the haptic feedback of the button 20.

Optionally, there may be a mask layer M coated on the light-emitting surface 212 of the covering portion 21, the mask layer M may partially cover the light-emitting surface 212 and may expose an area of a specific shape. For example, the area of the light-emitting surface 212 not covered by the mask layer M has a ring shape. Note that the formation of the mask layer and the shape that the mask layer exposes the light-emitting surface are not limiting.

In this embodiment, the pressing structure 22 may be located between the covering portion 21 and the switch SW. The pressing structure 22 may be the part of the button 20 used to directly contact or press the switch SW; that is, the covering portion 21 is able to activate the switch SW through the pressing structure 22. The pressing structure 22 is movably disposed on the first casing part 91 and/or the second casing part 92 of the casing 90. The pressing structure 22 may be made of any suitable light-permeable material. For example, the pressing structure 22 may be made of light-permeable rubber. In some embodiments, the covering portion 21 may be harder than the pressing structure 22 so as to provide better haptic feedback to the user and effectively reduce the wear or damage due to the pressing structure 22. In short, the material selection of the covering portion 21 and the pressing structure 22 is beneficial for haptic feedback and lifespan of the button 20.

The pressing structure 22 may have a light-receiving surface 221 and a light-emitting surface 222 located opposite to each other, the light-receiving surface 221 means the surface or area of the pressing structure 22 facing the light-emitting units L. The light-receiving surface 221 is configured to receive light emitted from the light-emitting units L. The light-emitting surface 222 means the surface or area of the pressing structure 22 facing the light-receiving surface 211 of the covering portion 21. The light-emitting surface 222 is configured to emit light to the covering portion 21.

Optionally, in this embodiment, the pressing structure 22 may have a plurality of recesses 2211 formed on the light-receiving surface 221. The recesses 2211 may respectively correspond to the light-emitting units L and are configured to receive the light emitted from different sides of each light-emitting unit L. As such, the light emitted from the light-emitting unit L may enter the light-receiving surface 221 of the pressing structure 22 in multiple directions, which is beneficial to improve the uniformity of light transferring in the pressing structure 22.

Optionally, in this embodiment, the pressing structure 22 may further include a sunken area 2212 and a contact bump 2213 located in the sunken area 2212, the sunken area 2212 is formed on the light-receiving surface 221 of the pressing structure 22, the contact bump 2213 protrudes towards the switch SW from the light-receiving surface 221 and is configured to directly contact or press the switch SW.

Optionally, in this embodiment, the covering portion 21 may include at least one first positioning portion 213, the pressing structure 22 may include at least one second positioning portion 223. The first positioning portions 213 may be located at the light-receiving surface 211 of the covering portion 21, the second positioning portions 223 may be located at the light-emitting surface 222 of the pressing structure 22. The first positioning portions 213 corresponds to the second positioning portions 223, respectively. One of the first positioning portion 213 and the second positioning portion 223 is a protrusion, the other one of the first positioning portion 213 and the second positioning portion 223 is a hole mating the protrusion. That is, the first positioning portion 213 and the second positioning portion 223 are engageable with each other; in other words, the first positioning portion 213 and the second positioning portion 223 are able to be connected to each other. When the covering portion 21 is stacked on the pressing structure 22, the first positioning portions 213 may be respectively engaged with the second positioning portions 223 and therefore secure the position of the covering portion 21 relative to the pressing structure 22.

Figure 5:
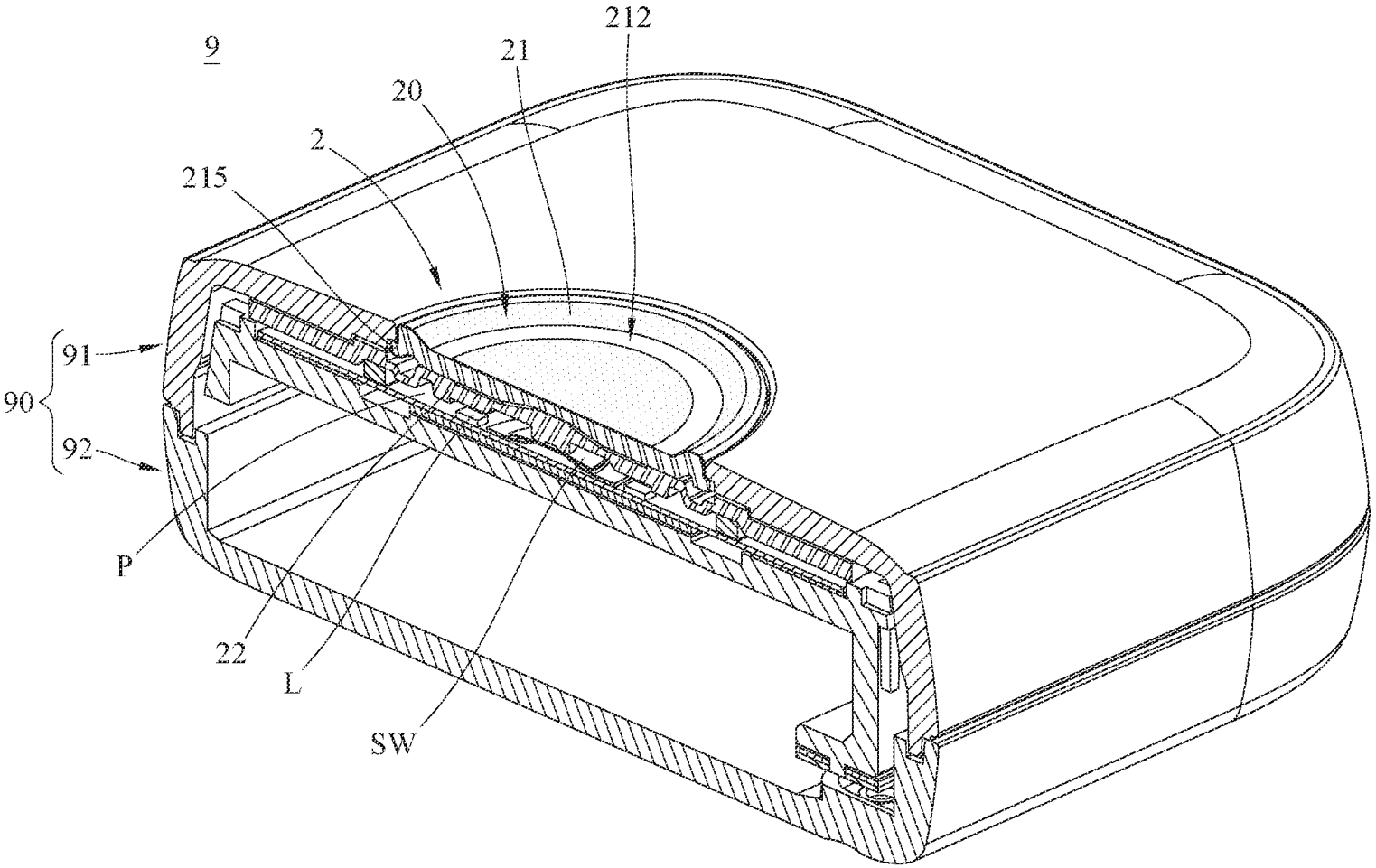
FIG. 5 is a prospective cross-sectional view of the electronic device according to one embodiment of the disclosure.
Figure 6:
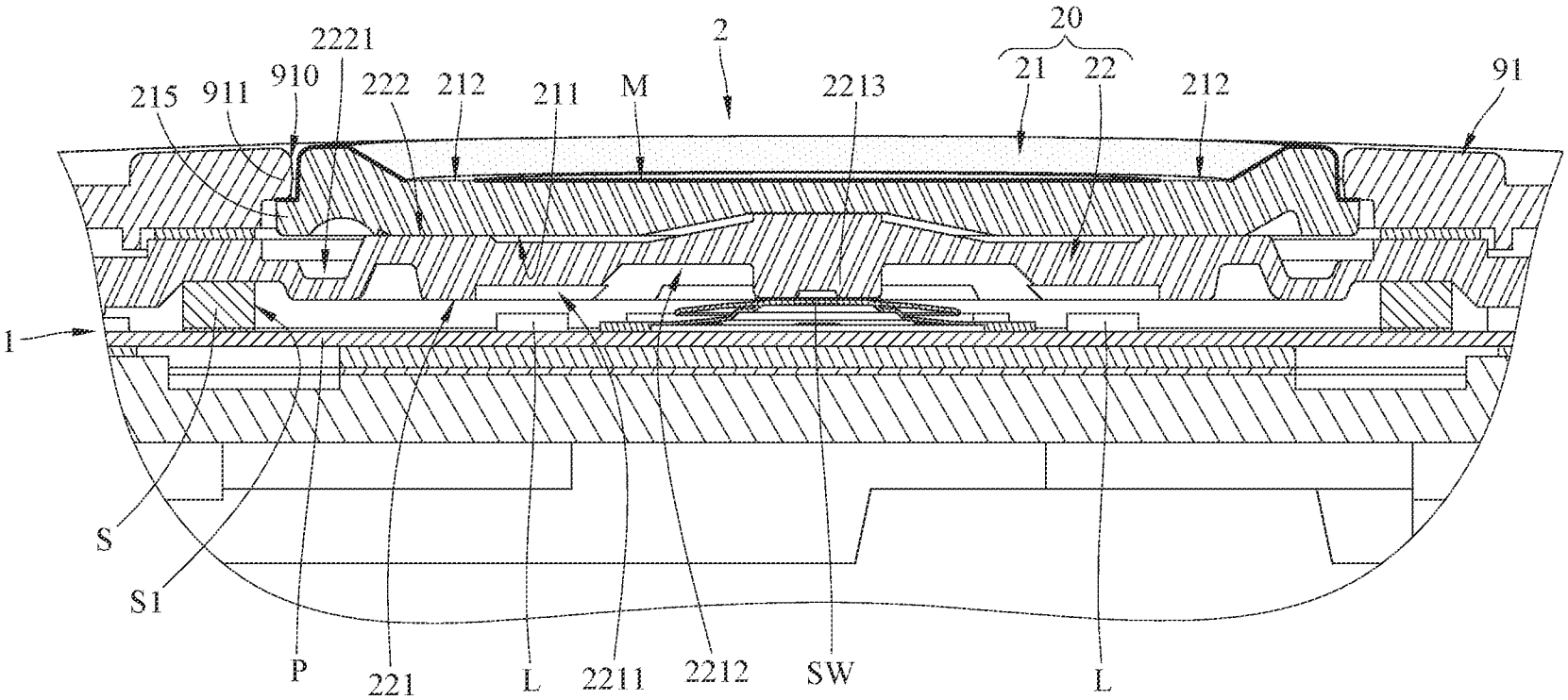
FIG. 6 is an enlarged view of FIG. 5.

Then, please further refer to FIGS. 5-6, when the switch SW is in contact with or not yet contact with the contact bump 2213 of the button 20, the light emitted by the light-emitting units L may enter the pressing structure 22 via the light-receiving surface 221. Specifically, the light emitted by the light-emitting units L may enter the pressing structure 22 multiple directions via the surfaces that form the recesses 2211 on the light-receiving surface 221. Through the transmission of the pressing structure 22, the light emits out of the light-emitting surface 222 of the pressing structure 22 and enters into the covering portion 21 via the light-receiving surface 211 of the covering portion 21. The light then emits to the outside from the light-emitting surface 212 of the covering portion 21.

As such, the light-emitting module 1 makes the button 20 become a luminous button and therefore improves both the legibility and aesthetics of the button 20. For example, the light-emitting module 1 may constantly emit light from the button 20. In another example, the light-emitting module 1 may emit a different light effect when the button 20 activates the switch SW. In one application, the light-emitting module 1 may emit light from the button 20 to express the current state of the electronic device 9 or to warn the user.

In the conventional buttons whose light sources have to laterally transmit light through a light guide plate before reaching the button, it is necessary to select a LED that has higher power due to the light loss caused by the light guide plate, but higher power LED has larger size and energy consumption. In contrast to the button structure 2 of the embodiment of the disclosure, the light-emitting units L are allowed to directly project light to the button 20 and thus there is no need to place an addition light guide plate between the light-emitting units L and the button 20 (i.e., there is no solid light guide existing between the light-emitting units L and the switch SW). As such, the light-emitting module 1 is less of a concern about the light loss than the conventional technique, such that the light-emitting units L are allowed to employ LEDS of lower energy consumption, thereby helping decrease overall energy consumption and improve the battery life. Also, since lower power LED has a smaller size, thus the selection of such LED help reduce the thickness of the button structure 2 and therefore is beneficial for miniaturization of the device.

Note that the button structure, the light-emitting module, and the electronic device of the previous embodiments are exemplary and may be further modified as required. For example, the quantity and arrangement of the light-emitting units may be changed as required. Alternatively, the button in other embodiments may omit the pressing structure and directly use the covering portion to press the switch; in such as case, the structures, such as recesses and/or contact bump may be rearranged to the light-receiving surface of the covering portion. Alternatively, in some other embodiments, the button may omit the covering portion and directly expose the pressing structure to the outside to receive the press by the user; in such a case, the mask layer may be rearranged to the light-emitting surface of the pressing structure.

Figure 7:
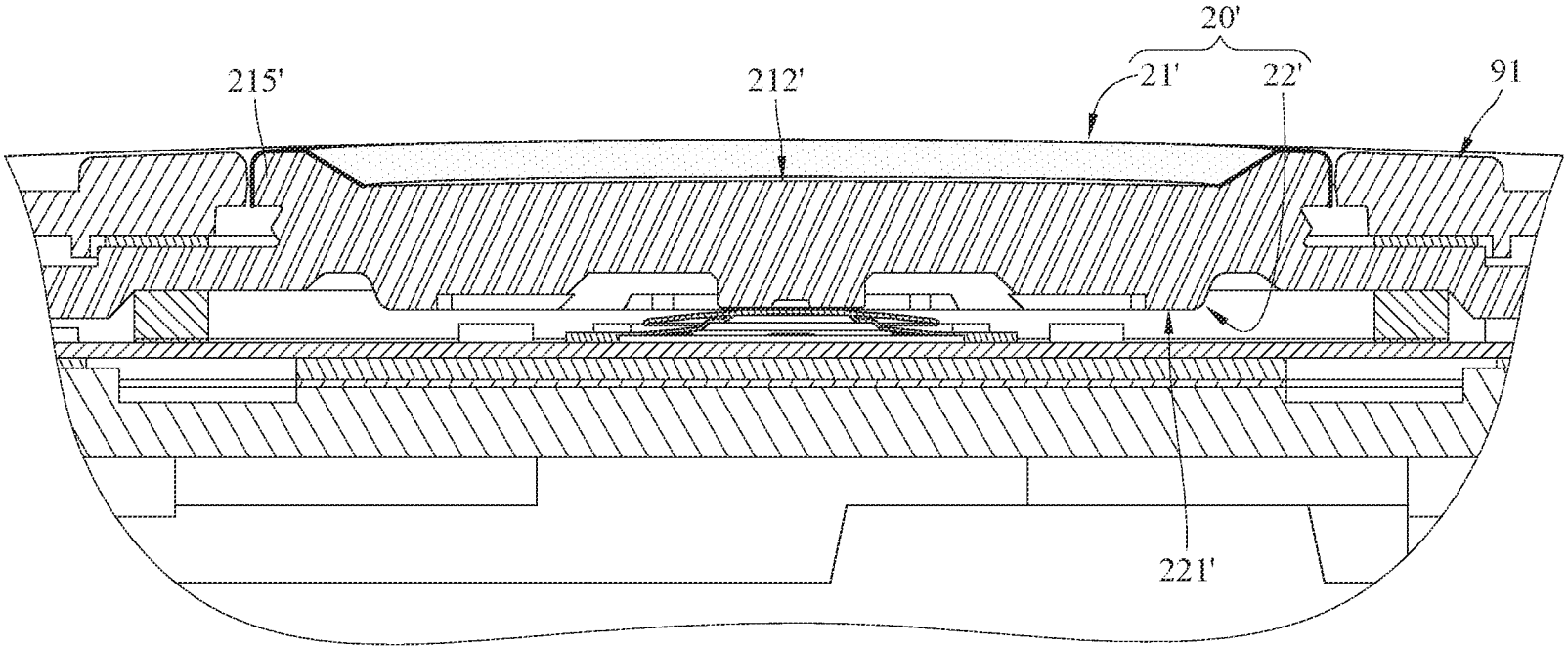
FIG. 7 is an enlarged cross-sectional view of a button according to another embodiment of the disclosure.

Alternatively, in some other embodiments, the pressing structure and the covering portion may be integrally formed into a single piece. For example, please refer to FIG. 7, one of an embodiment of the disclosure provides a button 20', its covering portion 21' is integrally formed with a pressing structure 22'. In specific, the covering portion 21' may be integrally formed on the side of the pressing structure 22' located opposite to its light-receiving surface 221'. Thus, the covering portion 21' and the pressing structure 22' may be produced by the same process and therefore is beneficial to simplify the manufacturing process and thereby reducing cost. In this arrangement, the button 20' receives light from the light-receiving surface 221' of the pressing structure 22' and transmits it to the light-emitting surface 212' of the covering portion 21'. Also, since the covering portion 21' is integrally formed with the pressing structure 22', the aforementioned first positioning portions and the second positioning portions are omitted. In addition, in this embodiment, a radially protruding portion 215' of the covering portion 21' may protrude radially outward from an edge of the covering portion 21' located close to the light-emitting surface 212' to increase the area of the button 20' for receiving press by the user. Since the radially protruding portion 215' is located relatively away from the pressing structure 22', the pressing structure 22' may omit the aforementioned recessed portion.

In some other embodiments, a suitable diffusion agent may be added to the covering portion and/or pressing structure of the button to make the covering portion and/or pressing structure more uniform in light transmission.

According to the light-emitting module and the button structure and the electronic device as discussed in the above embodiments of the disclosure, the light-emitting unit of the light-emitting module is arranged to correspond to the light-receiving surface of the light-permeable button, thus the light-emitting module is allowed to directly project light to the button, which helps improve both the legibility and aesthetics of the button and also helps achieve light effect in response to the interaction between the user and the button structure.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A button structure for an electronic device having a casing, the button structure comprising: a light-emitting module comprising: a substrate disposed on the casing; a switch disposed on the substrate; and a plurality of light-emitting units disposed on the substrate and surrounding the switch; and a button comprising a pressing structure and a covering portion, wherein the pressing structure and the covering portion are light-permeable, the pressing structure is located between the covering portion and the switch, and the plurality of light-emitting units correspond to a light-receiving surface of the pressing structure, a spacer disposed on the substrate below the pressing structure and surrounding the plurality of light-emitting units, wherein the spacer has a surrounding sidewall surrounding the plurality of light-emitting units, wherein the covering portion comprises at least one first positioning portion facing the pressing structure, the pressing structure comprises at least one second positioning portion facing the covering portion, and the at least one first positioning portion and the at least one second positioning portion are connected to each other.

2. The button structure according to claim 1, wherein the plurality of light-emitting units are spaced apart from each other, and distances from the plurality of light-emitting units to the switch are substantially the same.

3. The button structure according to claim 1, wherein the pressing structure has a plurality of recesses extending from the light-receiving surface of the pressing structure and respectively corresponding to the plurality of light-emitting units.

4. The button structure according to claim 1, further comprising a mask layer partially covering a light-emitting surface of the covering portion, wherein a part of the light-emitting surface of the covering portion not covered by the mask layer is in a ring shape.

5. The button structure according to claim 1, further comprising a mask layer, wherein the spacer is coplanar with the plurality of light-emitting units, the mask layer partially covers a light-emitting surface of the covering portion, a part of the light-emitting surface of the covering portion not covered by the mask layer is in a ring shape, the plurality of light-emitting units are spaced apart from each other and located adjacent to the switch, distances from the plurality of light-emitting units to the switch are substantially the same, the light-receiving surface of the pressing structure faces the plurality of light-emitting units, the pressing structure has a light-receiving surface facing the plurality of light-emitting units and a plurality of recesses located at the light-receiving surface thereof, the plurality of recesses respectively correspond to the plurality of light-emitting units.

* * * * *